US005494270A

United States Patent [19]

Laubscher

[11] Patent Number: 5,494,270

[45] Date of Patent: Feb. 27, 1996

[54] CROSS FOLDER AND METHOD OF CROSS FOLDING

[75] Inventor: Hans-Jörg Laubscher, Frankenthal, Germany

[73] Assignee: Heidelberger Druckmaschinen Aktiengesellschaft, Heidelberg, Germany

[21] Appl. No.: 242,120

[22] Filed: May 13, 1994

[30] Foreign Application Priority Data

May 13, 1993 [DE] Germany ..... 43 16 134.0

[51] Int. Cl.[6] ..... B42C 1/00; B41F 13/58; B31F 1/08

[52] U.S. Cl. ..... 270/49; 270/9; 270/51; 493/429; 493/432; 493/471

[58] Field of Search ..... 270/4, 8, 9, 16, 270/20.1, 21.1, 42, 49, 50; 493/425, 426, 427, 428, 429, 432, 471; 271/48, 51

[56] References Cited

U.S. PATENT DOCUMENTS

| | | | |
|---|---|---|---|
| 512,944 | 1/1894 | Carr | 493/429 X |
| 3,784,187 | 1/1974 | Takayanagi et al. | 270/6 X |
| 4,279,410 | 7/1981 | Bolza-Schunemann | 270/50 X |
| 4,490,132 | 12/1984 | Ogura et al. | 493/432 X |
| 4,746,107 | 5/1988 | Schneider et al. | 270/21.1 |
| 4,754,959 | 7/1988 | Kobler et al. | 270/21.1 |
| 5,386,979 | 2/1995 | Muller | 270/21.1 X |

FOREIGN PATENT DOCUMENTS

| | | | |
|---|---|---|---|
| 0019202 | 11/1980 | European Pat. Off. | 493/432 |
| 449118 | 8/1926 | Germany . | |
| 3527710 | 10/1988 | Germany . | |
| 3614263 | 10/1989 | Germany . | |

*Primary Examiner*—John E. Ryznic
*Attorney, Agent, or Firm*—Herbert L. Lerner; Laurence A. Greenberg

[57] ABSTRACT

Folder for cross folding printing products which have been cut from a web by a cutting device includes at least one cross folding device having a tucker blade cylinder and a folding jaw cylinder, the folding jaw cylinder having at least one folding jaw formed as a multiple jaw, the multiple jaw having a plurality of contiguous clamping jaws for holding a plurality of printing products brought together simultaneously while being cross folded; and method of cross folding.

14 Claims, 5 Drawing Sheets

CROSS FOLDER AND METHOD OF CROSS FOLDING

The invention relates to a cross folder and method of cross folding products or copies, preferably printed sheets, which have been cut from a web, in particular from a longitudinally cut partial web by means of a web slitter or longitudinal cutting device having at least one cross folder which includes a tucker blade cylinder and a folding jaw cylinder.

A folder of the foregoing general type has become known heretofore from German Patent 36 14 263. It has two separate folding groups for cross folding printed copies, a first printed copy held yet in folding jaws of a folding jaw cylinder in one of the folding groups being brought into a position wherein it is superposed with respect to a second printed copy supplied from the other folding group via conveyor belt or tape lines. This manner of combining or bringing together the two printed sheets can cause deviations; in other words, the alignment of the two printed copies sheets with respect to one another is not always correct. Moreover, the conventional folder has a relatively complex and expensive construction.

It is accordingly an object of the invention to provide a folder of the type described at the outset hereto which permits precise copy or product processing. Moreover, it is an object of the invention to provide such a folder which has a simple, compact structure wherein the folding jaw cylinder is readily accessible. Furthermore, It is also an object of the invention to provide a method of cross folding which delivers or produces extremely precise folding results.

With the foregoing and other objects in view, there is provided, in accordance with the invention, a folder for cross folding printing products which have been cut from a web by means of a cutting device, comprising at least one cross folding device having a tucker blade cylinder and a folding jaw cylinder, the folding jaw cylinder having at least one folding jaw formed as a multiple jaw, the multiple jaw having a plurality of contiguous clamping jaws for holding a plurality of printing products brought together simultaneously while being cross folded.

In accordance with another feature of the invention, the folder includes a plurality of tucker blade cylinders, respectively, for separate webs, the tucker blade cylinders having an operating relationship with the folding jaw cylinder.

In accordance with a further feature of the invention, the folder includes holding devices carried by the tucker blade cylinders for holding the printing products.

In accordance with an added feature of the invention, the holding devices include at least one pin device.

In accordance with an alternative feature of the invention, the holding devices include at least one gripper device.

In accordance with an additional feature of the invention, the folder includes a plurality of different delivery paths for the printing products, and a plurality of gripper cylinders cooperatively related with the folding jaw cylinder for selectively supplying the printing products to at least one of the respective different delivery paths.

In accordance with yet another feature of the invention, at least one of the gripper cylinders has a tucker blade arrangement forming a cooperative relationship with the folding jaw cylinder.

In accordance with yet a further feature of the invention, the folder includes a longitudinal folding device having a cooperative relationship with at least one of the delivery paths.

In accordance with yet an added feature of the invention, at least one of the gripper cylinders carries grippers thereon having a cooperative relationship with only one clamping jaw of the multiple jaw.

In accordance with yet an additional feature of the invention, the one clamping jaw is a leading clamping jaw, as viewed in the direction of rotation of the folding jaw cylinder.

In accordance with another feature of the invention, at least one of the gripper cylinders carries grippers thereon having a cooperative relationship with a plurality of the clamping jaws of the multiple jaw.

In accordance with a further feature of the invention, the multiple jaw is formed as a double folding jaw.

In accordance with an added feature of the invention, the double folding jaw has a clamping rib fixed to the folding jaw cylinder and formed with leading and trailing sides, as viewed in the rotational direction of the folding jaw cylinder, and respective clamping jaws are cooperatively engageable with the leading and trailing sides, respectively, of the clamping rib.

In accordance with another aspect of the invention, there is provided a method of cross folding printing products which have been cut from a web, which comprises applying a tucker blade of a tucker blade cylinder to at least two printing products for cross folding, and firmly clamping the printed products in the folding region for holding the printing products while, simultaneously with the firm clamping, transferring the printing products from the tucker blade cylinder to a folding jaw cylinder, including bringing the two printing products together during the folding process and holding the two printing products separately on the folding jaw cylinder, so that the two printing products are arranged in a given position relative to one another.

In accordance with a concomitant mode of the invention, the method includes arranging the two printing products in a position relative to one another wherein the respective folding edges of the two printing products are at least approximately coincidentally adjacent one another.

Thus, the folding jaw cylinder has at least one folding jaw, formed as a multiple jaw, which has a plurality of contiguous clamping jaws for holding a plurality of products in such a manner that they are simultaneously brought together and folded crosswise. According to the invention, bringing together a plurality of products is thus performed at the folding jaw cylinder, and this bringing together occurs simultaneously with the production of the cross fold on at least one product. For that purpose, the multiple jaw of the folding jaw cylinder is provided wherein a first, folded product is held, for example, and to which the further product is supplied for folding, preferably after the folding jaw cylinder has executed a partial rotation, following which the product, in cooperation with a folding blade cylinder, is taken up or received, during the formation of the fold, by an adjacent clamping jaw of the multiple jaw. The two products are thereby brought together in a position which is correctly aligned relative to one another. This bringing together can be performed exactly accurately, with respect to the mutual line-up of the leading edges thereof. Deviations, of the type which can occur in the prior art when products are brought together from belt or tape lines used as conveyor equipment, are avoided in the device and method of the invention because of the multiple jaw. The construction of the folder according to the invention is simple and therefore economical.

In a further construction according to the invention, a plurality of tucker or folding blade cylinders are provided, each of which serves for a respective separate web, and all of which are associated with the folding jaw cylinder. For example, if two partial webs are formed, by means of the aforementioned longitudinal cutting device, from one web supplied to a folder former, then two separate webs are thus available which can each be supplied to one tucker blade cylinder. A tucker blade cylinder or tucker blade cylinders may also simultaneously be formed as pin cylinders; in other words, they are suitable for fixing products that have been cut from the respective web. The fixing can be performed with pins or puncturing needles, for example. Alternatively, it is also possible for the fixing to be effected by grippers.

Because, as indicated above, a plurality of tucker blade cylinders, for example, two of them, may be associated with the folding jaw cylinder, it is possible for the respective separate webs (in particular, partial webs) each to cooperate with one folding blade cylinder, in order to supply products which have been cut from the web to the multiple jaw. This is effected in a manner that a first clamping jaw of the multiple jaw receives or takes up the product arriving from a first tucker blade cylinder, and a further, second clamping jaw of the multiple jaw clampingly receives the product arriving from another tucker blade cylinder. The reception of the products can take place at various angular positions of the folding jaw cylinder. The disposition of the tucker blade cylinders at different circumferential positions of the folding jaw cylinder leads to a space-saving design.

It is advantageous if a plurality of gripper cylinders for the possible selective supplying of the products to different delivery paths are associated with the folding jaw cylinder. These gripper cylinders are also located at various circumferential positions of the folding jaw cylinder. Preferably, two tucker blade cylinders and two gripper cylinders may be associated with the folding jaw cylinder. Because a plurality of gripper cylinders are present, work can be performed at a very high speed because, due to the multiple delivery paths which are available, there are no bottlenecks. If there are two delivery paths because there are two gripper cylinders, then twice as much time, when compared with a version having only one delivery path, is available, so that the second longitudinal fold, for example, can be executed without impairment of the production speed. Due to the greater spacings between the products, the sheets can be slowed down better and delivered more reliably.

At least one of the gripper cylinders may have a tucker blade arrangement which cooperates with the folding jaw cylinder. By means of the tucker blade arrangement, it is possible to perform a further cross fold for one product. One example is disclosed in FIG. 5 and the description thereof provided hereinafter.

In a preferred embodiment, a longitudinal folding device is associated with at least one of the delivery paths. Depending upon the particular folded product desired, a longitudinal fold may be made thereat.

Preferably, at least one of the gripper cylinders has grippers constructed and disposed, respectively, so that they cooperate only with one clamping jaw, in particular the leading clamping jaw, as viewed in the direction of rotation of the folding jaw cylinder, or only a few of the clamping jaws of the multiple jaw. This gripper accordingly does not cooperate with all of the clamping jaws of the multiple jaw, so that it does not receive all of the products retained in the multiple jaw, but only some of them, or in other words those which are retained in the clamping jaws with which the gripper cooperates. The remaining products can be received later by a different gripper cylinder. This makes it possible to separate the products retained in the multiple jaw and to supply them to a plurality of delivery paths, for example.

In a particularly preferred exemplary embodiment, the multiple jaw is embodied as a double-fold jaw; that is, it has two clamping jaws so that it is possible to retain two products independently of one another. In particular, the double-fold clamp has a cylinder-fast (folding clamp cylinder-fast) clamping rib; that is, this clamping rib is disposed not movably but rather stationary on the folding jaw cylinder. One clamping jaw each cooperates with the front and rear sides of the clamping rib, in order to create the two clamping possibilities mentioned above. If one clamping jaw, with the product incorporated between, meets one side of the clamping rib, then the clamping seat is created there; if the other clamping jaw meets the other side of the clamping rib, then a tongs-like retaining device for the further product is created there.

The invention also relates to a method for cross folding products, preferably printed copies, which have been cut from a web, in particular a longitudinally cut partial web, by means of a longitudinal cutting device, which has the following method steps: For cross folding, the products are acted upon by a tucker blade of a tucker blade cylinder and are firmly clamped for holding purposes in the folding region while, simultaneously with the firm clamping, a transfer from the tucker blade cylinder to a folding jaw cylinder takes place, and at least two products are brought together during the folding process and held separately on the folding jaw cylinder during the process, so that they are arranged in a desired relative position, in particular with coincident or approximately coincident folding edges adjacent one another.

Other features which are considered as characteristic for the invention are set forth in the appended claims.

Although the invention is illustrated and described herein as embodied in a cross folder and method of cross folding, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figures 1, 2, 3, 4, 5:
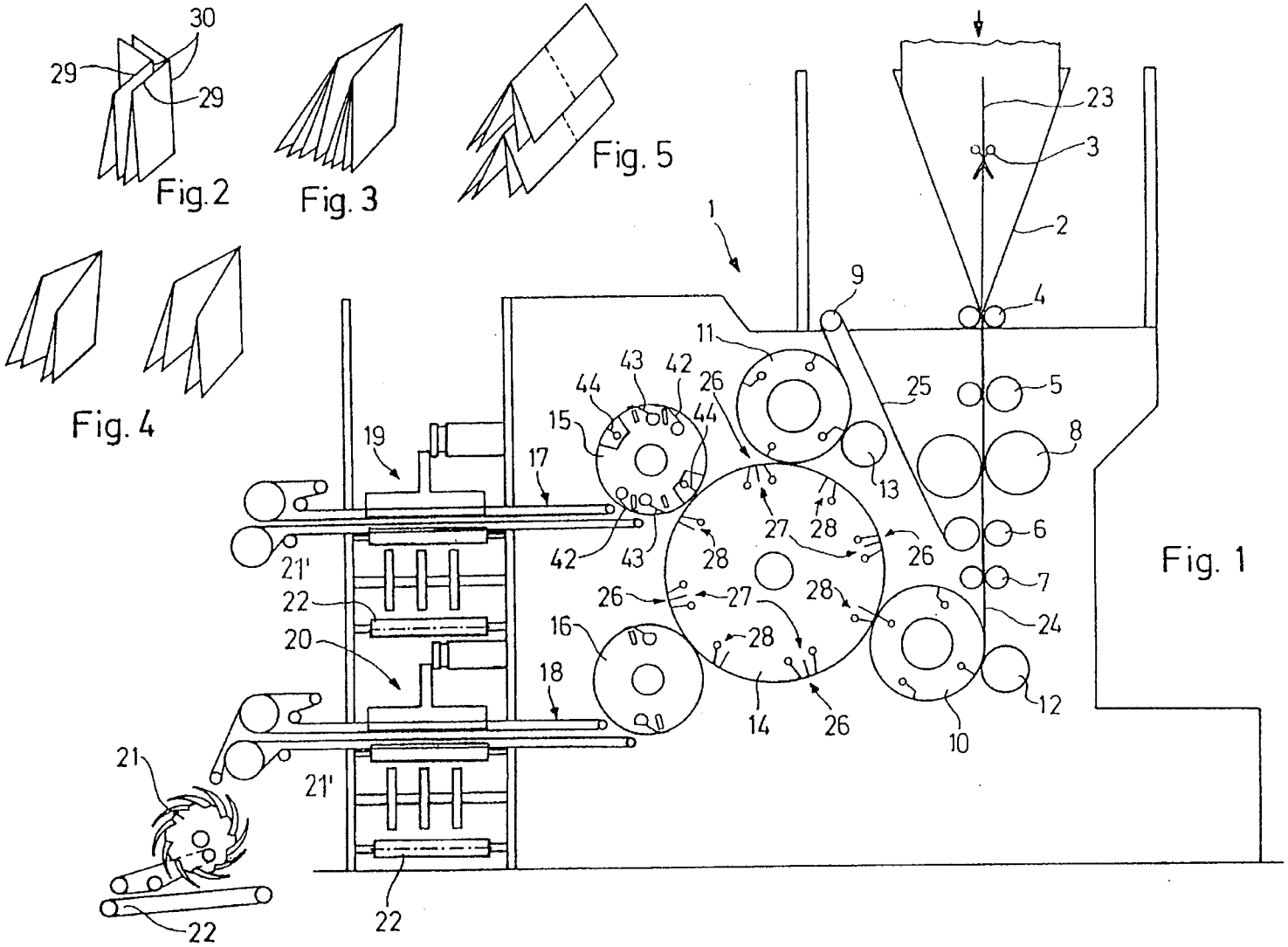
FIG. 1 is a diagrammatic side elevational view of a folder according to the invention.
FIGS. 2 to 5 are perspective views of various products (folded products) or signatures processed by the folder.
Figure 7:
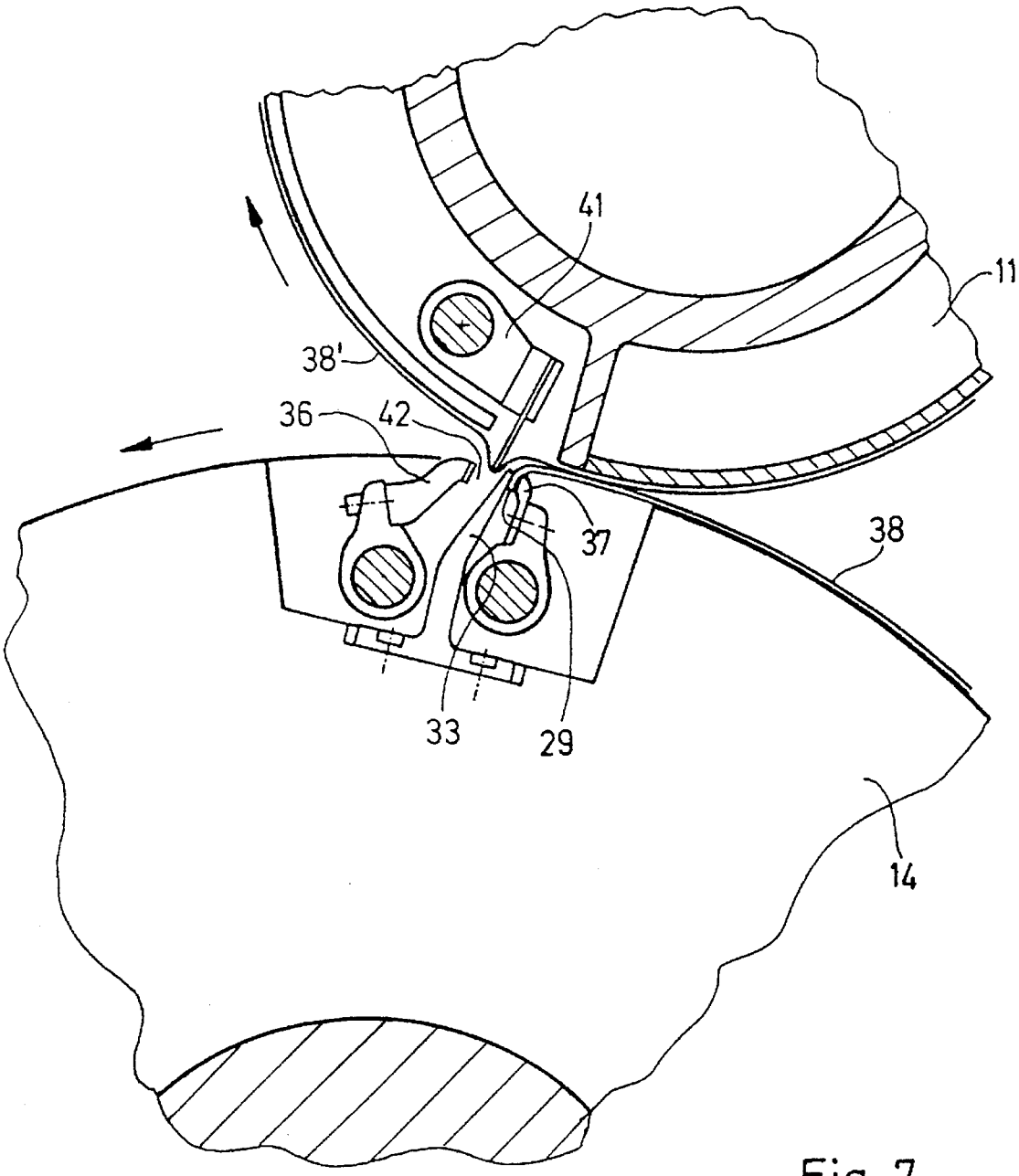
FIG. 7 is a view similar to that of FIG. 6 of the folding jaw cylinder and the tucker blade cylinder at another region and in another operating phase thereof.
Figure 8:
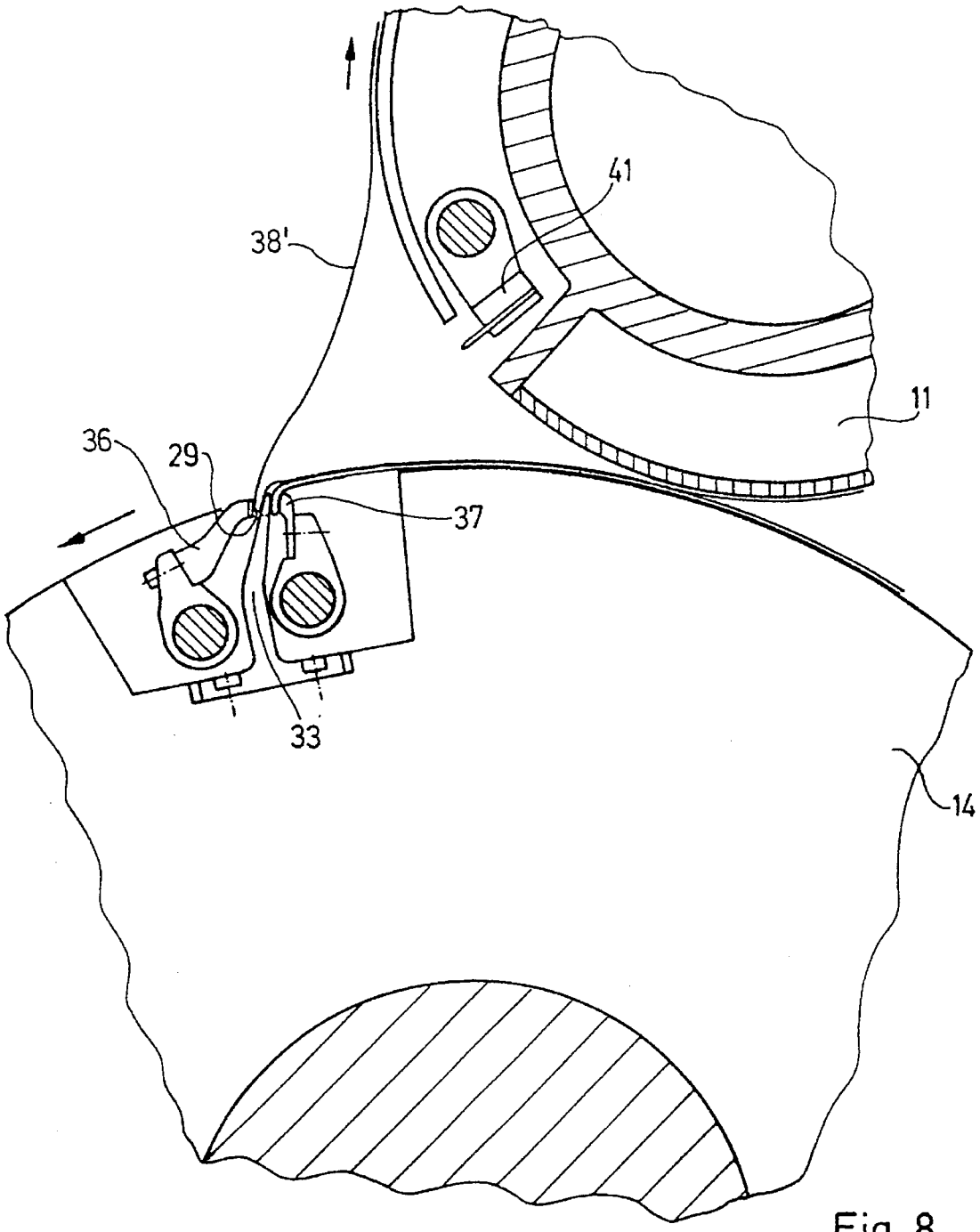
Figure 9:
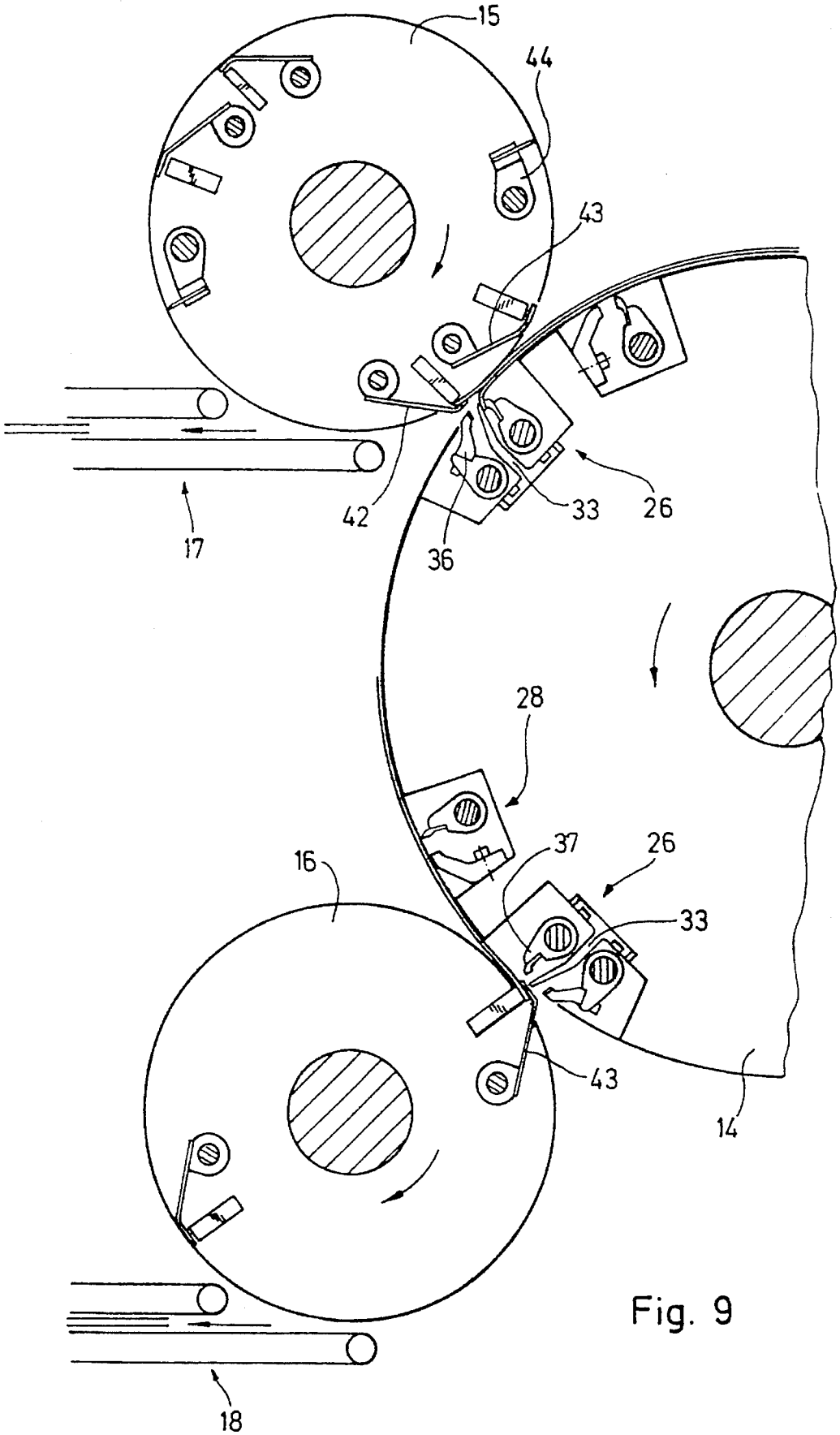

FIG. 8 is a view similar to that of FIG. 7 of the folding jaw cylinder and the tucker blade cylinder at a different rotary position of the aforementioned cylinders subsequent to the position thereof shown in FIG. 7 and in a further operating phase thereof; and FIG. 9 is a much-enlarged fragmentary cross-sectional view of FIG. 1, showing respective regions of the folding jaw cylinder and of two gripper cylinders in the vicinity of two delivery paths of the folder.

Referring now to the drawings and, first, particularly to FIG. 1 thereof, there is shown therein, in a diagrammatic view, a folder 1 having a folder former 2 and a longitudinal cutting device 3, symbolically represented by a pair of scissors. Four pairs of guide rollers 4, 5, 6 and 7 are also provided at locations spaced apart from one another and beneath the folder former 2. A cross-perforating unit 8 disposed between the guide roller pairs 5 and 6 may optionally be used. A deflection roller 9 is associated with the guide roller pair 6.

Two tucker blade cylinders 10 and 11 are also provided, each of which cooperates with a respective cutting cylinder 12 or 13. The tucker blade cylinders 10 and 11 also form pin cylinders. A folding jaw cylinder 14 cooperates with the two tucker blade cylinders 10 and 11 and is also operatively connected to two gripper cylinders 15 and 16. A tucker blade arrangement is associated with at least the gripper cylinder 15, so that the tucker blade arrangement simultaneously forms a cross-folding cylinder.

Adjoining the gripper cylinders 15 and 16 are delivery paths 17 and 18, respectively, with which longitudinal folding devices 19 and 20, respectively, are associated. A respective paddle or fan wheel 21 and a delivery belt 22 may be disposed at the end of the delivery paths 17 and 18; this is represented in FIG. 1, in the interest of simplicity, only with respect to the lower discharge path 18 illustrated therein.

A web 23, for example a paper web, runs into the folder former 2 of the folder 1 and is folded longitudinally by means of the folder former 2 or divided by means of the longitudinal cutting device 3 into two separate webs (partial webs or web lengths 24 and 25) and turned on the folder former 2 so that one of the partial webs is superimposed on the other. Products, preferably printed copies or signatures, are then produced from the partial webs 24 and 25 by separating or detaching and by folding. This will be discussed in further detail hereinbelow.

The folding jaw cylinder 14 has at least one and preferably several folding jaws 27 formed as multiple jaws 26, and is also provided with conventional, single folding jaws 28. The various folded products shown in FIGS. 2 to 5, which may be produced by the folder 1 as well as by other means, will be addressed initially hereinbelow.

FIG. 2 shows a two-part folded product, each part of which has a cross fold 29. The two parts rest on one another with the cross folds 29 thereof congruent, and are provided with a "common" longitudinal fold 30, i.e., the word "common" is intended to indicate that this longitudinal fold 30 is made simultaneously in both of the parts in a single operation.

FIG. 3 shows a folded product which is likewise formed of two parts, but, in contrast with the product of FIG. 2, the two parts of FIG. 3 do not rest on but in one another.

FIG. 4 illustrates a folded product having two parts which are formed like the parts of FIG. 2 but which do not rest on one another but instead are separated parts (folded products) which were folded separately along both second longitudinal folds.

FIG. 5 shows a two-part product with separate first cross folds and a common second cross fold made with the folder.

Figure 6:
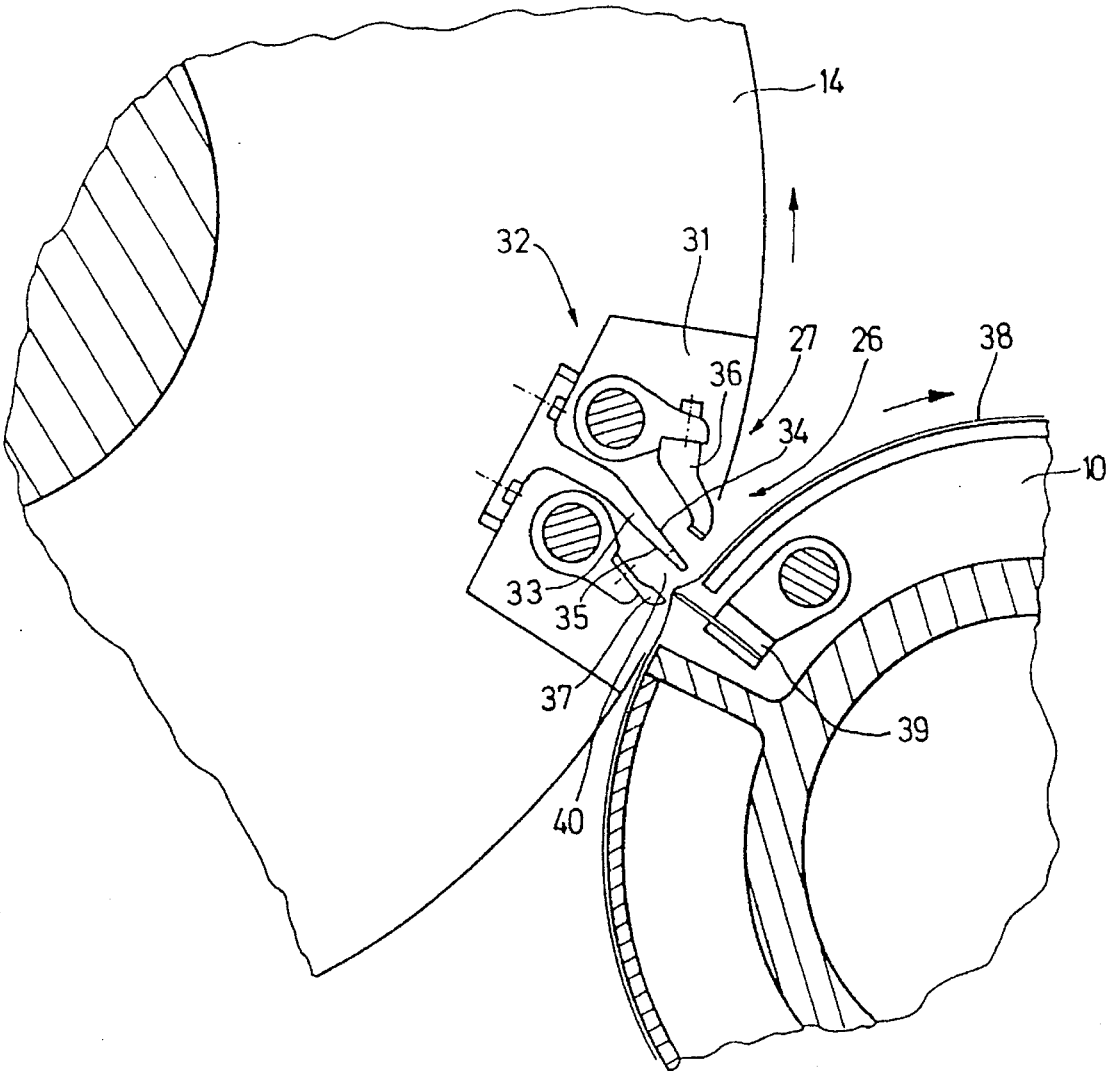
FIG. 6 is a much-enlarged fragmentary cross-sectional view of FIG. 1, showing respective regions of a tucker blade cylinder and a folding jaw cylinder of the folder in a given operating phase thereof.

FIG. 6 shows the structural layout of the folding jaw 27 formed as a multiple jaw 26 in greater detail. The multiple jaw 26 is disposed in a recess 31 of the folding jaw cylinder 14. It will be described in detail hereinafter in the form of a double folding jaw 32. The double folding jaw 32 has an immovable clamping rib 33 which is stationary relative to the folding jaw cylinder 14, and a swivelably mounted clamping jaws 36 and 37, respectively, cooperating with leading and trailing sides 34 and 35, respectively, of the clamping rib 33.

If the multiple jaw 26 should have more than two clamping jaws (a condition which is not shown), then a suitable plurality of clamping ribs is provided with a suitable number of clamping jaws. Alternatively, it is also possible for one clamping jaw to cooperate with the rear of the adjacent clamping jaw.

Each clamping jaw 36 and 37, respectively, is formed of a plurality of spaced-apart clamping ribs distributed over the length of the cylinder 14, so that the product is clamped at a plurality of locations along its length.

The production of the folded product of FIG. 2 will now be described in greater detail. The web 23 supplied to the folder former 2 is divided by the longitudinal cutting device 3 into the partial webs or web lengths 24 and 25 and rotated 90° lengthwise. The partial web 24 is engaged or seized by a pin device of the tucker blade cylinder 10 and, at the respective other end, is severed by the cutting cylinder 12. A thus-cut and detached product 38 (FIG. 6) is accordingly located on the outer jacket surface of the tucker blade cylinder 10 and, as this cylinder 10 rotates, is brought to the position thereof shown in FIG. 6. Intermediate the leading and trailing edges of the product 38, or shifted half the length of the pre-folded portion or post-folded portion of the product 38 away from the middle, is a tucker or folding blade 39 on the tucker blade cylinder 10, which is released by a corresponding control device of the folder 1, the instant the double folding jaw 32 of the folding jaw cylinder 14 assumes a position opposite thereto; that is, the tucker blade 39 presses a loop into the product 38, and the loop rests in the clamping gap 40 which is provided between the clamping jaw 37 and the clamping rib 33 facing towards it. The clamping jaw 37 closes and entrains or carries the product 38 with it, as the cylinders 10 and 14 continue to rotate, thereby forming a cross fold 29, as seen in FIG. 7.

The partial web 25 is deflected on a roller of the guide or draw roller pair 6 (FIG. 1) and is both guided over the deflection roller 9 and directed toward the tucker blade cylinder 11. In cooperation with the cutting cylinder 13, a corresponding cutting operation takes place, as has been described heretofore with respect to the cutting cylinder 12. A suitably cut-off product 38', as shown in FIG. 7, which is held and entrained or carried along by a pin device of the tucker blade cylinder 11, is introduced by means of a tucker or folding blade 41 into a clamping gap 42, in an appropriate rotational position of the folding jaw cylinder 14 and the tucker blade cylinder 11, in the course of loop formation, and is held there clampingly by the closure of the clamping jaw 36 and carried along or entrained as a result of the further rotation of the cylinders 11 and 14. The cross fold 29 is thereby formed in the product 38', the cross folds 29 of the products 38 and 38' rest on one another, separated only by the narrow clamping rib 33 from one another, and with the edges thereof precisely even with one another. In other words, the products 38 and 38' are brought together simultaneously during the folding operation.

In the course of further operation, the products 38 and 38', thus held resting on one another, are received or taken over by suitable grippers of the gripper cylinders 15 and 16, respectively. It is possible for only the gripper cylinder 15 or only the gripper cylinder 16 to receive or take over the products, or for the gripper cylinders 15 and 16 to operate alternatingly, which has the advantage that twice as much time is available in the ensuing longitudinal folding operation performed in the second longitudinal fold. The corresponding products are then folded lengthwise or, in other words, the longitudinal fold 30 is made, by means of the longitudinal folding device 19 or 20, and the longitudinal folding devices 19 and 20, respectively. The thus-finished product is received by the paddle or fan wheel 21 or by the paddle or fan wheels 21' of the second longitudinal folds and transferred to the delivery belts 22.

To produce a folded product as in FIG. 3, the web 23 is divided in the folder former 2 by means of the longitudinal cutting device 3, and then one part is inverted onto the other. No dividing of the individual webs 24 and 25 takes place, however; but rather, these two webs continue to extend parallel to one another or in other words rest on one another and are processed with only one tucker blade cylinder (folding blade cylinder 10 or folding blade cylinder 11). In the discussion which follows hereinafter, reference will be made only to the tucker blade cylinder 10.

Once the severing has been performed by the cutting cylinder 12, the two parts of the partial webs 24 and 25 resting on one another reach the folding jaw cylinder 14, by means of a tucker blade of the tucker blade cylinder 10, are engaged or gripped and firmly held by a respective clamping jaw 36, 37 of the double folding jaw 32; in other words, the double folding jaw 32 is not used for double clamping but is used in the manner of a single folding jaw. The parts, thus cross folded in common, are supplied selectively to the upper or lower delivery by means of the gripper cylinder 15 or 16. It is also conceivable, however, for delivery to be effected alternatingly via the two gripper cylinders 15 and 16, which permits the operation to be performed at a higher speed. In the course of the delivery, a corresponding longitudinal folding is then performed with the aid of the longitudinal folding device 19 and/or 20. In all the exemplary embodiments described hereinbefore, the delivery paths 17 and 18 are preferably formed as belt or tape lengths.

To furnish the product of FIG. 4, the sequence is just the same as for furnishing the product of FIG. 2. The only difference is that in the transfer of the products 38 and 38' to the gripper cylinders 15 and 16, some special features are provided, which are described hereinafter.

It is apparent from FIG. 1 that the gripper cylinder 15 has various kinds of grippers, namely short grippers 42 and long grippers 43. This is especially clearly shown in FIG. 9. By means of the long grippers 43 which are considered to be normal grippers and which are present with the gripper cylinder 16 as well, all of the products 38, 38' held or retained by individual clamping jaws 36 and 37 of one multiple jaw 26 are seized and taken over. However, if the short gripper 42 of the gripper cylinder 15 comes into use, as in FIG. 9, then it takes over only the product 38 from the leading clamping jaw 36, in terms of the direction of rotation, while the (long) gripper 43 of the gripper cylinder 16, in the course of further rotation, takes over the product 38' from the trailing clamping jaw 37. In this manner, it is thus possible to separate the products 38 and 38' once again, and correspondingly feed them to the delivery paths 17 and 18. After forming the yet-absent longitudinal fold, the product of FIG. 4 is produced.

In addition to the cross fold 29 of the products, a further cross fold is possible, according to FIG. 1, with the cooperation of the folding jaw cylinder 14 and the gripper cylinder 15. This can be done for the products of FIGS. 2 and 3, for example. An arrangement of this type may also be employed in order to produce delta-shaped folds. For this purpose, a corresponding offset is required among the devices used. To enable the production of the second cross fold, the corresponding product is received or taken up by the corresponding grippers of the gripper cylinder 15, but no delivery has yet occurred. Instead, at least one tucker blade arrangement 44 is provided on the gripper cylinder 15 and introduces a loop of the product into a corresponding single folding jaw 28 of the folding jaw cylinder 14. Due to the closure of the folding jaw, this loop is formed as a second cross fold, and the product is accordingly carried along by the folding jaw cylinder 14 as the grippers of the gripper cylinder 15 open, and is finally delivered by means of the gripper cylinder 16. It is possible, thereby, to provide products such as that of FIG. 5.

In the choice of whether to use a short gripper 42 or a long gripper 43, a corresponding shift in rotational position between the folding jaw cylinder 14 and the gripper cylinder 15 is performed. Because of the multiple jaw 26, the folds held there are slightly shifted circumferentially. This could lead to a deviation from the accurately superposed position of the products. This can be compensated for or evened out by ensuring that the corresponding tucker blades will extend to different depths within the clamping gap, thereby forming a correspondingly larger or smaller loop, which results in the compensation.

I claim:

1. A folder for cross-folding printing products which have been cut from a web be means of a cutting device, comprising at least one cross-folding device having a tucker blade cylinder and a folding jaw cylinder, said folding jaw cylinder having a folding jaw unit essentially consisting of a pair of first and second clamping jaws for holding respective printing products, and for bringing the respective printing products into exact superposition while the printing products are simultaneously being cross-folded.

2. Folder according to claim 1, including a plurality of tucker blade cylinders, respectively, for separate webs, said tucker blade cylinders having an operating relationship with said folding jaw cylinder.

3. Folder according to claim 1, including holding devices carried by said tucker blade cylinders for holding the printing products.

4. The folder according to claim 1, wherein said first and second clamping jaws make a clamping movement from respectively opposite directions for clamping the respective printing products.

5. A folder for cross folding printing products which have been cut from a web by means of a cutting device, comprising at least one cross folding device having a tucker blade cylinder and a folding jaw cylinder, said folding law cylinder having at least one folding jaw formed as a multiple jaw, said multiple jaw having a plurality of contiguous clamping jaws for holding a plurality of printing products brought together simultaneously while being cross folded, and a plurality of different delivery paths for the printing products, and a plurality of gripper cylinders cooperatively related with said folding jaw cylinder for selectively supplying the printing products to at least one of the respective different delivery paths.

6. Folder according to claim 5, wherein at least one of said gripper cylinders has a tucker blade arrangement forming a cooperative relationship with said folding jaw cylinder.

7. Folder according to claim 5, including a longitudinal folding device having a cooperative relationship with at least one of said delivery paths.

8. Folder according to claim 5, wherein at least one of said gripper cylinders carries grippers thereon having a cooperative relationship with only one clamping jaw of said multiple jaw.

9. Folder according to claim 8, wherein said one clamping jaw is a leading clamping jaw, as viewed in the direction of rotation of said folding jaw cylinder.

10. Folder according to claim 5, wherein at least one of said gripper cylinders carries grippers thereon having a cooperative relationship with a plurality of the clamping jaws of the multiple jaw.

11. Folder according to claim 5, wherein said multiple jaw is formed as a double folding jaw.

12. A folder for cross folding printing products which have been cut from a web by means of a cutting device, comprising at least one cross folding device having a tucker blade cylinder and a folding jaw cylinder, said folding jaw cylinder having at least one folding jaw formed as a double folding jaw, said double folding jaw having a plurality of contiguous clamping jaws for holding a plurality of printing products brought together simultaneously while being cross folded, wherein said double folding jaw has a clamping rib fixed to said folding jaw cylinder and formed with leading and trailing sides, as viewed in the rotational direction of the folding jaw cylinder, and respective clamping jaws cooperatively engageable with said leading and trailing sides, respectively, of said clamping rib.

13. Method of cross folding printing products which have been cut from a web, which comprises applying a tucker blade of a tucker blade cylinder to at least two printing products for cross folding, and firmly clamping the printed products in the folding region for holding the printing products while, simultaneously with the firm clamping, transferring the printing products from the tucker blade cylinder to a folding jaw cylinder, including bringing the two printing products together during the folding process and holding the two printing products separately on the folding jaw cylinder, so that one of the two printing products is superimposed on the other of the two printing products.

14. Method according to claim 13, which includes arranging the two printing products in a position relative to one another wherein the respective folding edges of the two printing products are at least approximately coincidentally adjacent one another.

* * * * *